US008512001B2

(12) United States Patent
Benkler et al.

(10) Patent No.: US 8,512,001 B2
(45) Date of Patent: Aug. 20, 2013

(54) TURBOMACHINE ROTOR COMPRISING A PRETENSIONING DEVICE FOR PRETENSIONING A ROTOR BLADE

(75) Inventors: Francois Benkler, Ratingen (DE); Jörn Bettentrup, Dorsten (DE); Frank Deister, Willich (DE); Rudolf Küperkoch, Essen (DE); Nicolas Savilius, Essen (DE); Oliver Schneider, Wesel (DE); Dirk Wistuba, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 440 days.

(21) Appl. No.: 12/867,567

(22) PCT Filed: Jan. 23, 2009

(86) PCT No.: PCT/EP2009/050781

§ 371 (c)(1),
(2), (4) Date: Nov. 10, 2010

(87) PCT Pub. No.: WO2009/100975

PCT Pub. Date: Aug. 20, 2009

(65) Prior Publication Data

US 2011/0171031 A1 Jul. 14, 2011

(30) Foreign Application Priority Data

Feb. 14, 2008 (EP) ..... 08002768

(51) Int. Cl.
*F01D 25/06* (2006.01)

(52) U.S. Cl.
USPC ..... 416/221; 416/220 R

(58) Field of Classification Search
USPC ..... 416/204 R, 205, 215, 218, 219 A, 416/219 R, 220 R, 221, 228, 248; 29/889.7, 29/889.72, 519, 407.02
See application file for complete search history.

(56) References Cited

U.S. PATENT DOCUMENTS

| | | | |
|---|---|---|---|
| 1,829,881 | A | 11/1931 | Tucker |
| 2,786,648 | A | 3/1957 | Ledwith |
| 2,857,132 | A | 10/1958 | McDowall |
| 4,102,602 | A | 7/1978 | Rottenkolber |
| 5,123,813 | A | 6/1992 | Hemsworth |

FOREIGN PATENT DOCUMENTS

| | | |
|---|---|---|
| DE | 834 408 | 7/1949 |
| DE | 1 156 419 B1 | 10/1963 |
| DE | 1156419 B | 10/1963 |
| GB | 2 026 101 A | 1/1980 |
| JP | 59168878 A | 9/1984 |

*Primary Examiner* — Edward Look
*Assistant Examiner* — Maxime Adjagbe

(57) ABSTRACT

A turbomachine rotor, a rotor blade and a method for assembling a turbomachine rotor are provided. The turbomachine rotor includes a rotor blade with a blade root, a wheel disk with a groove in which the blade root engages such that the rotor blade is maintained in the groove in a positive fit in a radial direction. Further, a pretensioning device is provided, which is supported on the wheel disk as well as on the blade root and which exerts a pretensioning force on the blade root in the radial direction. The pretensioning device is designed such that the pretensioning force can be adjusted when assembling the turbomachine rotor.

20 Claims, 2 Drawing Sheets

TURBOMACHINE ROTOR COMPRISING A PRETENSIONING DEVICE FOR PRETENSIONING A ROTOR BLADE

CROSS REFERENCE TO RELATED APPLICATIONS

This application is the US National Stage of International Application No. PCT/EP2009/050781 filed Jan. 23, 2009, and claims the benefit thereof. The International Application claims the benefits of European Application No. 08002768.3 EP filed Feb. 14, 2008. All of the applications are incorporated by reference herein in their entirety.

FIELD OF INVENTION

The invention refers to a turbomachine rotor with a pretensioning device for pretensioning a rotor blade, to the rotor blade with the pretensioning device and to a method for assembling the turbomachine rotor.

BACKGROUND OF INVENTION

A gas turbine is a thermal turbomachine in which fossil fuels, such as natural gas, are conventionally combusted. The gas turbine can be used for example in a gas and steam power plant which is provided for covering peaks loads in a mains network. As a result, the gas turbine is run in non-steady state operation, as a result of which the individual components and component parts of the gas turbine are subjected to transient loads. On account of the high power density of the gas turbine, high requirements with regard to the strength of highly loaded components are to be fulfilled in order to ensure a long service life of these components and long maintenance cycles and also a low demand for replacement parts.

The gas turbine, has a compressor with a compressor rotor and a turbine with a turbine rotor, wherein the compressor rotor and the turbine rotor are interconnected via a shaft in a torsionally fixed manner. The compressor rotor and/or the turbine rotor are conventionally designed in an axial type of construction, i.e. a multiplicity of wheel disks are slid on the shaft one behind the other. A rotor blade row is fastened on the outer peripheries of the wheel disks in each case. Each rotor blade row has a large number of rotor blades which in each case have an aerodynamically effective blade airfoil and a blade root. The blade root is inserted into a groove which is located on the outer periphery of the wheel disk so that the rotor blade is retained in a form-fitting manner on the blade root especially in the radial direction of the gas turbine rotor.

For the form-fitting retention of the rotor blade, the blade root and the groove have dovetail profiles or fir-tree profiles which correspond to each other. These profiles are arranged in a manner extending in the axial direction of the gas turbine rotor so that for installing the rotor blade this is inserted by its blade root into the groove in the axial direction of the gas turbine rotor. Between the blade root and the profile of the groove a clearance is provided so that the blade root can be inserted into the groove free of wear. Induced by the clearance, the rotor blades can move during operation of the gas turbine, which leads to a characteristic rattling of the rotor blade. This applies particularly to a large and heavy rotor blade, as is provided especially in the first rotor blade rows of the compressor of the high performance gas turbine.

The rotor blade is conventionally installed in the groove with pretension in order to avoid the rattling. However, installation can be made difficult on account of the pretension, especially in the case of the large and heavy rotor blade.

Furthermore, the pretension in the wheel disk and in the blade root causes a mechanical stress which is conventionally compensated by a stable and solid construction of the wheel disk and of the blade root. Provision can be made in the groove for an axial locking plate with which the rotor blade is secured and additionally pretensioned against axial displacement. However, the axial locking plate may be formed too weak for the large and heavy rotor blade.

Such an axial locking plate is known from U.S. Pat. No. 2,786,648 and U.S. Pat. No. 4,102,602. The slotted ends of the plate in these cases project beyond the ends of the groove. At each end, the teeth which are created as a result of the slots are bent reciprocally outwards and inwards in each case in order to avoid axial displacement of the rotor blade along the groove. Moreover, the plate is curved in the middle in order to retain the rotor blade in the groove in a pretensioned state.

Furthermore, instead of the aforesaid plate, it is known from U.S. Pat. No. 5,123,813 to provide a dowel-like construction with a screw between the bottom of the retaining groove and the underside of the blade root for creating the pretension. Patent specification DE 834 408 features a further variant in which the pretensioning device for rotor blades of a turbine is created by means of a screwable double wedge which is provided between groove bottom and blade root.

Fastening of the locking blade of a blade ring, the blades of which are inserted into a circumferential groove with undercut flanks through a filling opening, is known from DE 11 56 419. For fastening the locking blade, provision is made for a plurality of radial grub screws which are screwed in each case into a thread which is arranged in halves in each case on an end face of the blade root of the locking blade on one side and in the flank of the filling opening on the other side. According to an alternative development, it is possible to use dowel pins which are inserted in holes which exist in halves and which are provided in the end faces of the locking blade and in the end faces of those rotor blades which are adjacent to the locking blade.

Moreover, a fastening plate for a rotor blade which is axially inserted in a retaining groove is known from GB 2 026 101.

SUMMARY OF INVENTION

It is an object of the invention to create a turbomachine rotor, a rotor blade, and a method for assembling the turbomachine rotor, wherein the turbomachine rotor can be operated with high stability and efficiency without rattling of the rotor blades.

The turbomachine rotor has grooves which are distributed uniformly along the periphery and in which a rotor blade is inserted by a blade root in each case so that the rotor blade is retained in a form-fitting manner by the groove in the radial direction, and has a pretensioning device which is supported both on a bottom of the groove and on the blade root and which exerts a pretensioning force upon the blade root in the radial direction, wherein the pretensioning device is installed in such a way that the pretensioning force is adjustable in the assembled state of the turbomachine rotor.

As a result, when assembling the turbomachine rotor, i.e. during the axial insertion of the blade root into the groove, it is made possible for the pretensioning force to be provided at a low value and in the assembled state of the turbomachine rotor for the pretensioning force to be adjusted to a high value as predetermined. Therefore, during insertion of the blade root into the groove the pretensioning force is advantageously low so that wear on the blade root and in the groove on account of installation of the rotor blade is prevented.

Furthermore, the expenditure of force during insertion of the blade root into the groove is advantageously low so that during installation of the rotor blade only low stress peaks in the blade root and in the wheel disk occur. Consequently, these stress peaks during the stress calculation of the blade root and of the turbomachine rotor hardly need to be taken into consideration and the installation of the rotor blade in the turbomachine rotor is simple.

The pretensioning device, moreover, has at least one adjusting screw, with which by applying a predetermined tightening torque the pretensioning force can be adjusted in the assembled state of the turbomachine rotor.

By means of the adjusting screw, adjusting the predetermined pretensioning force is made possible via the setting of a tightening force of the adjusting screw. As a result, the pretensioning force can be applied to the rotor blade via the tightening torque. The adjusting screw is preferably provided with a fine thread so that an accurate force transfer of the adjusting screw from the tightening torque to the pretensioning force is made possible.

Furthermore, by the provision of the adjusting screw, removal of the rotor blade by loosening the adjusting screw is made possible so that removal of the rotor blade is simple. Therefore, quick reinstallation of the rotor blade with care for the material is made possible.

Also, provision is made in the blade root for at least one threaded hole which on the underside of the blade root facing the bottom of the groove leads into this, wherein at least one adjusting screw is screwed into the at least one threaded hole so that it projects on the blade root by its end and is indirectly supported on the bottom of the groove.

Consequently, the adjusting screw penetrates the blade root through the threaded hole and is fixed therein so that by supporting the screw end indirectly on the bottom of the groove the pretensioning force is applied to the blade root in the radial direction.

The grooves which are distributed along the periphery are preferably arranged in a wheel disk of the turbomachine rotor. As a result of this, a modular turbomachine rotor can be disclosed.

The pretensioning device preferably has a support plate which is arranged on the bottom of the groove at least in the region of the one adjusting screw so that the adjusting screw and the support plate are in touching contact.

The support plate lies in the groove directly on the bottom so that an additional groove does not need to be provided in the bottom of the groove for the support plate.

Furthermore, the bottom of the groove is covered by the support plate in the region of the adjusting screw so that the bottom of the groove is only in indirect contact with the end of the adjusting screw via the support plate. Therefore, the end of the adjusting screw damaging the bottom of the groove, especially when turning the adjusting screw, is prevented.

Furthermore, it is preferred that the at least one threaded hole, by its end which faces away from the underside of the blade root, leads out on one of the end faces of the blade root so that the threaded hole is inclined away from the longitudinal axis of the turbomachine rotor by an acute angle.

As a result, the threaded hole is accessible on the end face of the blade root so that from there the adjusting screw can be adjusted after installation of the rotor blade onto the wheel disk. Furthermore, since the threaded hole extends from the end face of the blade root to the bottom of the blade root, the threaded hole penetrates the blade root in a mechanically low-stressed region. Consequently, by the provision of the threaded hole in the blade root this is compromised little in its strength.

On account of the inclination of the adjusting screw by the acute angle, the pretensioning force which is applied by the adjusting screw has an axial and a radial component. This is advantageous since, as a result, both the radial pretensioning force and an axial force are applied for locking the rotor blade in the wheel disk. Consequently, both a radial and an axial fastening of the rotor blade are ensured. Via the degree of inclination of the adjusting screw, the distribution of the force which is transmitted by the adjusting screw can be distributed to the axial and radial fastening.

It is preferred that the support plate has at least one offset with a flat flank, which is formed in such a way that the end of the adjusting screw butts by the end face against the flat flank. The end face of the end of the adjusting screw is preferably also formed flat so that during the flat abutment of the screw end against the flank the surface pressure is low. As a result, an extreme mechanical loading of the support plate by the adjusting screw is prevented, as a result of which an undesirable distortion of the support plate on account of the action of the adjusting screw does not occur so that jamming of the adjusting screw is prevented.

It is preferred that the blade root has a first threaded hole with a first adjusting screw and a second threaded hole with a second adjusting screw, wherein the first threaded hole leads out on the one end face of the blade root and the second threaded hole leads out on the other end face so that the first threaded hole is inclined away from the longitudinal axis of the turbomachine rotor by a first acute angle and the second threaded hole is inclined away by a second acute angle.

As a result, the two adjusting screws are arranged in an oppositely inclined manner to relation to each other so that the axial force components which are applied to the support plate act against each other. Consequently, a stable fastening of the blade root in the groove can be advantageously achieved, wherein a little to no resulting axial force acts upon the blade root.

Also, it is preferred that the support plate has the first offset with the first flank, against which butts the end of the first adjusting screw, and the second offset with the second flank, against which butts the end of the second screw.

Therefore, the rotor blade is locked by its blade root in a form-fitting manner in the axial direction via the adjusting screws on the flanks of the offsets of the support plate.

It is preferred that the first angle and the second angle have the same value.

As a result, the pretensioning device is formed symmetrically in the plane perpendicular to the axial direction of the turbomachine rotor so that the distribution of the pretensioning forces in the pretensioning device is symmetrical. Therefore, the pretensioning device, the blade root and the wheel disk are evenly stressed.

Furthermore, it is preferred that the support plate has a back section between the two offsets, which by its convex side faces the blade root.

The support plate is preferably produced from an elastic material. Induced by the pretensioning forces, which are exerted by the adjusting screws upon the flanks of the offsets, these are pressed in the direction towards the bottom of the groove. As a result, the back section is bent so that the back section by its convex side presses onto the underside of the blade root. Consequently, the pretensioning forces which the adjusting screws exert upon the support plate are transferred to the blade root. Therefore, the pretensioning of the rotor blade is increased.

Also, it is preferred that the back section is pre-bent before its installation so that in the assembled state of the turbomachine rotor the back section presses onto the underside of the blade root.

As a result, the support plate has a spring action in the direction towards the underside of the blade root, as a result of which a pretensioning reserve is created for the event of settling, i.e. if during operation the distance between the underside of the blade root and the bottom of the groove increases. Furthermore, the pre-bending of the back section enables a good frictional engagement in the assembled state via the surface contact which is formed by the adjusting screws. Via the rigidity and the thickness of the support plate, the pretensioning reserve can be predefined. By adjusting the adjusting screws, the pretensioning reserve can be further varied in the assembled state.

It is preferred that on the first offset the support plate has a first leg section which extends away from the back section, and on the second offset has a second leg section which extends away from the back section.

Consequently, the effect is achieved of the support plate being supported flat, and therefore with low surface pressure, on the bottom of the groove. The first leg section preferably has a first projection and the second leg section has a second projection, wherein the projections project from the groove over the wheel disk. As a result, the support plate in the assembled state can be gripped from the outside by the projections so that removal and reinstallation of the rotor blade can be carried out in a simple manner.

Furthermore, it is preferred that the projections are arranged in an angled-down manner in relation to the leg sections so that the turbomachine rotor or the wheel disk are in engagement with the support plate and consequently is fixed in the axial direction of the turbomachine rotor.

As a result, the support plate is fixed on the wheel disk in the axial direction, especially even if the rotor blade is not yet inserted into the groove of the wheel disk when assembling the turbomachine rotor. Therefore, when assembling the turbomachine rotor, the support plate, which is positioned in the groove on the bottom, does not have to be fixed from the outside if the rotor blade root is inserted into the groove. The projection can preferably be bent round or turned over.

It is preferred that the at least one adjusting screw is secured against inadvertent rotation by a securing means.

As a result, the adjusting screw accidentally becoming loose during operation of the turbomachine rotor is prevented. The securing means can preferably be an adhesive. Alternatively or in addition to this, the adjusting screw can be prick-punched in the rotor blade by a center punch blow.

The geometrical dimensioning of the support plate, of the adjusting screws and of the tightening torque is matched to the mass of the rotor blade.

The rotor blade according to the invention, which is provided for installing in a groove which is located on the outer periphery of a turbomachine rotor and extends in the axial direction, has a blade root with two end faces which lie opposite each other and are arranged perpendicularly to the longitudinal axis of the blade root, and with a blade root underside which extends between the two end faces, wherein the blade root has a first threaded hole and a second threaded hole, wherein the two threaded holes lead out on the underside of the blade root on one side, and on the other side the first threaded hole leads out on the one end face of the blade root and the second threaded hole leads out on the other end face so that the first threaded hole is inclined away from the longitudinal axis of the turbomachine rotor by a first acute angle and the second threaded hole is inclined away by a second acute angle.

The support plate for pretensioning a rotor blade of a turbomachine rotor has a longitudinal direction and has two opposed offsets, which are arranged along this, with a planar flank in each case, between which the support plate has a back section.

The method according to the invention for assembling a turbomachine rotor features the steps: providing the turbomachine rotor with grooves which are distributed along the periphery and extend essentially in the axial direction of the turbomachine rotor, and with rotor blades which are arranged therein in each case, and with a support plate; inserting the rotor blade into the groove so that the blade root engages in the groove and so the rotor blade is retained in a form-fitting manner in the groove in the radial direction; inserting the support plate into the groove between the underside of the blade root and the bottom of the groove; screwing of the first adjusting screw into the first threaded hole and screwing the second adjusting screw into the second threaded hole until the adjusting screws contact their corresponding offsets; tightening down the two adjusting screws with a predetermined tightening torque in order to pretension the rotor blade in the groove in the radial direction with a predetermined pretensioning force.

BRIEF DESCRIPTION OF THE DRAWINGS

Preferred exemplary embodiments of a turbomachine rotor according to the invention and of a support plate are explained in the following text with reference to the attached schematic drawings.

In the drawing.

DETAILED DESCRIPTION OF INVENTION

Figure 1:
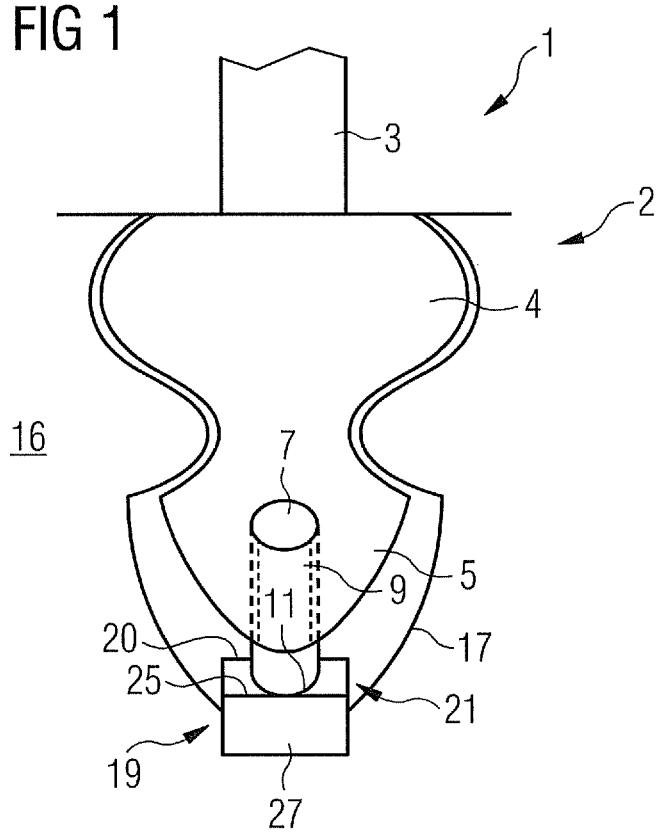
FIG. 1 shows a cross section through the turbomachine rotor in the region of a blade root.
Figure 2:
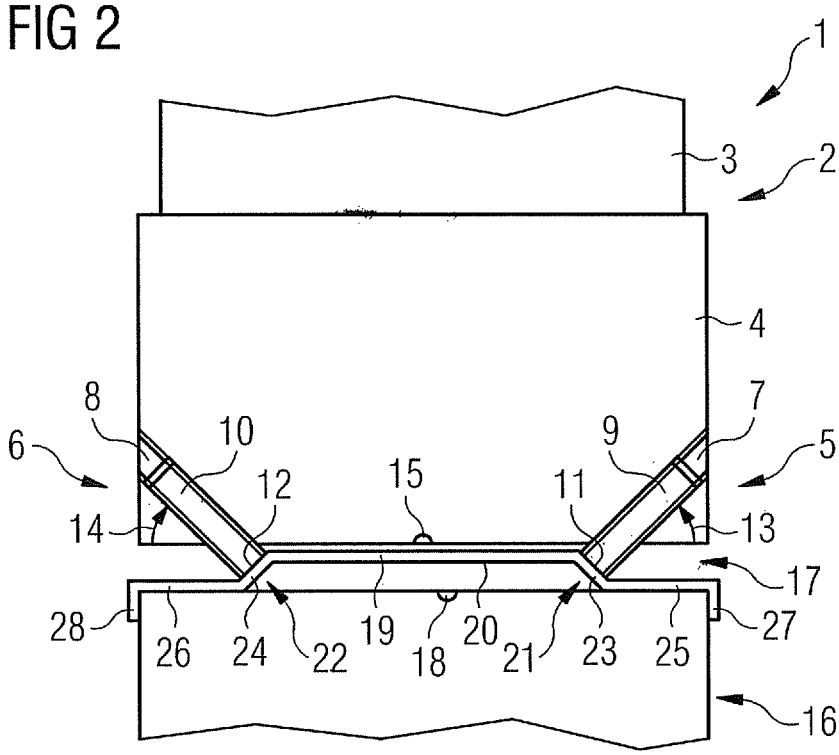
FIG. 2 shows a longitudinal section of the turbomachine rotor in the region of the blade root.

As is apparent from FIGS. 1 and 2, a turbomachine rotor 1 has a multiplicity of rotor blades 2 and a wheel disk 16. The rotor blades 2 are fastened on the periphery of the wheel disk 16 so that a rotor stage of the turbomachine rotor 1 is formed.

The rotor blade 2 is produced in one piece and has a blade airfoil 3 and a blade root 4. The blade airfoil 3 is aerodynamically effective, for example in a compressor or a turbine of a turbomachine. The blade root 4 serves for fastening the blade airfoil 3 on the wheel disk 16.

The blade root 4, in a plane which is perpendicular to the rotational axis of the turbomachine rotor, has a fir-tree profile-like cross section, and in a plane in which lies the rotational axis of the turbomachine rotor, has a rectangular cross section. The rectangular cross section of the blade root 4 is formed by a longitudinal side, which the blade airfoil 3 adjoins, two end faces facing away from each other which in each case are perpendicular to the rotational axis of the turbomachine rotor 1, and a blade root underside 15 which is arranged essentially parallel to the rotational axis of the turbomachine rotor 1 and facing away from the blade airfoil 3. In the corner regions of the blade root 4, which lie in the region of the edges which are formed by the end faces and the underside 15 of the blade root, the blade root 4 has mechanically low-stressed regions 5 and 6.

The first mechanically low-stressed region 5 of the blade root 4 is penetrated by a first threaded hole 7 and the second mechanically low-stressed region 6 of the blade root 4 is penetrated by a second threaded hole 8, wherein the two threaded holes 7, 8 lead out on the underside 15 of the blade root and the first threaded hole 7 leads out on the one end face of the blade root 4 and the second threaded hole 8 leads out on the other end face of the blade root 4. A first adjusting screw 9 is screwed into the first threaded hole 7 and a second adjusting screw 10 is screwed into the second threaded hole 8. The first adjusting screw 9 has a first end 11 and the second adjusting screw 10 has a second end 12, wherein the screw ends 11, 12 are located in each case outside the blade root 4 on the underside 15 of the blade root.

The two threaded holes 7, 8 and also the two adjusting screws 9, 10 are arranged in an inclined manner in relation to each other so that the first threaded hole 7 with the rotational axis of the turbomachine axis 1 includes a first angle 13 and the second threaded hole 8 with the rotational axis of the turbomachine rotor 1 includes a second angle 14. The two threaded holes 7, 8 are arranged in relation to each other in such a way that the two ends 11, 12 of the two adjusting screws 9, 10 are arranged in a manner in which they face each other. The first angle 13 and the second angle 14 are acute angles in each case and are of equal size in value. The wheel disk 16 has a groove 17 with a bottom 18 which is in engagement with the blade root 4. The shape of the groove 17 is formed in such a way that it encloses the longitudinal sides of the blade root 4 and the underside 15 of the blade root in a form-fitting manner so that the rotor blade 2, by means of the fir-tree profile of the blade root 4, is retained in a form-fitting manner in the groove 17 in the radial direction and in the circumferential direction of the turbomachine rotor 1. The groove 17 and the blade root 4 are formed in such a way that during installation of the turbomachine rotor 1 the rotor blade 2 can be inserted by its blade root 4 essentially in the axial direction of the turbomachine rotor 1. With the turbomachine rotor 1 assembled, the end faces of the blade root 4 terminate essentially planar with the end faces of the wheel disk 16.

The groove 17 is dimensioned in such a way that a gap is formed between the bottom 18 of the groove and the underside 15 of the blade root. A support plate 19, which in its middle has a back section 20 which is formed by a first offset 21 and a second offset 22, is inserted into the gap. A first leg section 25 is connected to the first offset 21 and a second leg section 26 is connected to the second offset 22, wherein the leg sections 25, 26 butt against the bottom 18 of the groove and the back section 20 butts against the underside 15 of the blade root. The back section 20 and the leg sections 25, 26 are arranged in alignment with each other.

The first offset 21 has a first flank 23 and the second offset 22 has a second flank 24, wherein the first screw end 11 butts against the first offset 21 and the second screw end 12 butts against the second offset 24. Both the first screw end 11 and the first flank 23, and also the second screw end 12 and the second flank 24, are formed in a planar manner so that the contact between the adjusting screws 10, 11 and the support plate 19 is created via a contact surface. The two adjusting screws 9, 10 are screwed into their threaded holes 7, 8 and tightened down with a predetermined tightening torque in such a way that a predetermined force is exerted by the adjusting screws 9, 10 upon the flanks 23, 24 and therefore upon the support plate 19 in each case. The force has a radial component and an axial component, wherein if the two adjusting screws 9, 10 are tightened down with the same tightening torque the axial components cancel each other out. The radial components form a predetermined pretensioning force with which the blade root 4 is pretensioned in the groove 17 in a predetermined manner.

A first projection 27 is provided on the first leg section 25 and a second projection 28 is provided on the second leg section 26, wherein the projections 27, 28 extend away from the groove 17 over the wheel disk 16. The two projections 27, 28 are arranged in an angled-down manner in relation to the leg sections 25, 26 in the direction towards the middle of the turbomachine rotor 1 so that by the projections 27, 28 the support plate 19, lying on the bottom 18 of the groove, is arranged in a fixed manner in the axial direction of the turbomachine rotor 1.

Figure 3:
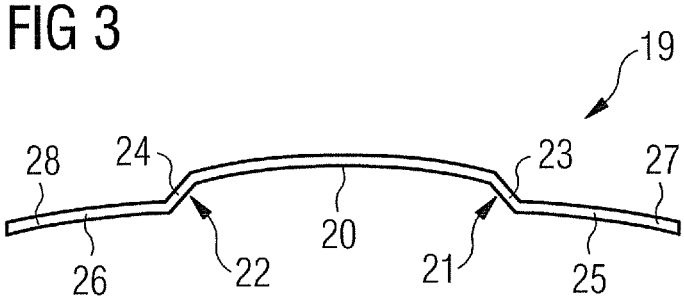
FIG. 3 shows a support plate in the uninstalled state.
Figure 4:
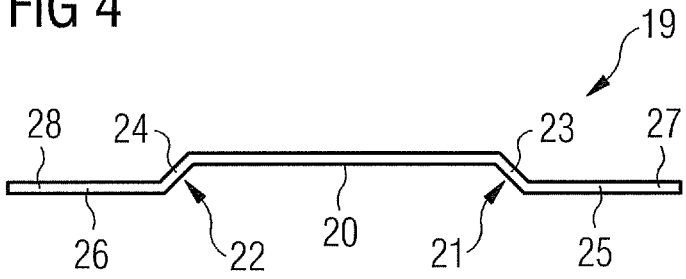
FIG. 4 shows the support plate in the installed state.

The support plate 19 is shown in FIGS. 3 and 4, wherein the first projection 27 is arranged as an extension of the first leg section 25 and the second projection 28 is arranged as an extension of the second leg section 26.

In FIG. 3, the support plate 19 is shown in the uninstalled state and in FIG. 4 shown in the installed state. The support plate 19 is manufactured in a pre-bent condition so that the support plate 19 in the uninstalled state has a convex contour. If the support plate 19, as it is shown in FIG. 4, is installed in the groove 17 together with the blade root 4, then the support plate 19 is pressed straight so that the support plate 19, on account of spring properties, exerts a spring force upon the blade root 4. In the case of a method for assembling the turbomachine rotor 1, the rotor blade 2 is inserted into the groove 17 essentially in the axial direction of the turbomachine rotor 1 until the end faces of the blade root 4 are arranged in alignment with the end faces of the wheel disk 16. The support plate 19, according to the embodiment which is shown in FIG. 3, is inserted in the gap which is formed between the underside 15 of the blade root and the bottom 18 of the groove until the two projections 27 and 28 project from the wheel disk 16. Then, the first adjusting screw 9 is screwed into the first threaded hole 7 and the second adjusting screw 12 is screwed into the second threaded hole 8 until the first screw end 10 contacts the first flank 23 and the second screw end 12 contacts the second flank 24. The adjusting screws 9, 10 are subsequently tightened down with the predetermined tightening torque. The projections 27 and 28 are then bent in the direction towards the middle of the wheel disk 16 so that the projections 27, 28 butt against the wheel disk.

The invention claimed is:

1. A turbomachine rotor, comprising:

a plurality of grooves which are distributed along a periphery and extend essentially in an axial direction of the turbomachine rotor;

a plurality of rotor blades, one rotor blade being arranged in each groove, wherein a blade root of each rotor blade engages in one of the grooves such that the rotor blade is retained in the groove in a form-fitting manner in a radial direction;

a pretensioning device which is supported both on a bottom of the groove and on the blade root and exerts a pretensioning force upon the blade root in the radial direction, the pretensioning device being arranged such that the pretensioning force is adjustable, wherein the pretensioning device has an adjusting screw for adjusting the pretensioning force by applying a predetermined tightening torque, wherein each blade root comprises a threaded hole which on an underside of the blade root, facing the bottom of the groove, leads into the groove, and wherein the adjusting screw is screwed into the threaded hole such that the adjusting screw projects on the blade root by an end of the adjusting screw and is indirectly supported on the bottom of the groove.

2. The turbomachine rotor as claimed in claim 1, wherein the plurality of grooves are arranged in a wheel disk.

3. The turbomachine rotor as claimed in claim 1, wherein the pretensioning device comprises a support plate arranged on the bottom of the groove at least in the region of the adjusting screw such that the adjusting screw is in touching contact with the support plate.

4. The turbomachine rotor as claimed in claim 1, wherein the threaded hole leads out on one of end faces of the blade root via an end of the threaded hole facing away from an underside of the blade root such that the threaded hole is inclined away from a longitudinal axis of the turbomachine rotor by an acute angle.

5. The turbomachine rotor as claimed in claim 3, wherein the support plate comprises an offset with a flank, the offset being formed such that the end of the adjusting screw butts by an end face of the adjusting screw flat against the flank.

6. The turbomachine rotor as claimed in claim 4, wherein the blade root has a first threaded hole with a first adjusting screw and a second threaded hole with a second adjusting screw, wherein the first threaded hole leads out on the one end face of the blade root and the second threaded hole leads out on the other end face such that the first threaded hole is inclined away from the longitudinal axis of the turbomachine rotor by a first acute angle and the second threaded hole is inclined away by a second acute angle, and wherein the first angle and the second angle have the same value.

7. The turbomachine rotor as claimed in claim 5, wherein the blade root has a first threaded hole with a first adjusting screw and a second threaded hole with a second adjusting screw, wherein the first threaded hole leads out on the one end face of the blade root and the second threaded hole leads out on the other end face such that the first threaded hole is inclined away from the longitudinal axis of the turbomachine rotor by a first acute angle and the second threaded hole is inclined away by a second acute angle, and wherein the first angle and the second angle have the same value.

8. The turbomachine rotor as claimed in claim 6, wherein the support plate comprises a first offset with a first flank, an end of the first adjusting screw butting against the first flank, and a second offset with a second flank, an end of the second adjusting screw butting against the second flank.

9. The turbomachine rotor as claimed in claim 7, wherein the support plate comprises a first offset with a first flank, an end of the first adjusting screw butting against the first flank, and a second offset with a second flank, an end of the second adjusting screw butting against the second flank.

10. The turbomachine rotor as claimed in claim 8, wherein the support plate has a back section between the two offsets, a convex side of the back section facing the blade root, and wherein the back section is pre-bent before an installation so that in an assembled state of the turbomachine rotor the back section presses onto the underside of the blade root.

11. The turbomachine rotor as claimed in claim 9, wherein the support plate has a back section between the two offsets, a convex side of the back section facing the blade root, and wherein the back section is pre-bent before an installation so that in an assembled state of the turbomachine rotor the back section presses onto the underside of the blade root.

12. The turbomachine rotor as claimed in claim 10, wherein the support plate comprises a first leg section on the first offset, the first leg section extending away from the back section, and a second leg section on the second offset, the second leg section extending away from the back section.

13. The turbomachine rotor as claimed in claim 11, wherein the support plate comprises a first leg section on the first offset, the first leg section extending away from the back section, and a second leg section on the second offset, the second leg section extending away from the back section.

14. The turbomachine rotor as claimed in claim 12, wherein the first leg section has a first projection and the second leg section has a second projection, wherein the projections project from the groove.

15. The turbomachine rotor as claimed in claim 13, wherein the first leg section has a first projection and the second leg section has a second projection, wherein the projections project from the groove.

16. The turbomachine rotor as claimed in claim 14, wherein the projections are arranged in an angled-down manner in relation to the leg sections such that the turbomachine rotor is in engagement with the support plate and consequently is fixed in the axial direction of the turbomachine rotor.

17. The turbomachine rotor as claimed in claim 1, wherein the adjusting screw is secured against inadvertent rotation by a securing device.

18. A rotor blade, comprising:

a blade root which, for installing the rotor blade, is inserted into a groove located on an outer periphery of a turbomachine rotor, the blade root comprising two end faces arranged opposite each other and arranged perpendicularly to a longitudinal axis of the blade root, and a blade root underside which extends between the two end faces, wherein the blade root has a first threaded hole and a second threaded hole, wherein the two threaded holes lead out on an underside of the blade root on one side, and on the other side the first threaded hole leads out on the one end face of the blade root and the second threaded hole leads out on the other end face.

19. The rotor blade as claimed in claim 18, wherein the first threaded hole is inclined away from the longitudinal axis of the turbomachine rotor by a first acute angle and the second threaded hole is inclined away by a second acute angle, and wherein the first angle and the second angle have the same value.

20. A method for assembling a turbomachine rotor, comprising:

providing a turbomachine rotor with grooves which are distributed along a periphery and extend essentially in an axial direction of the turbomachine rotor;

providing rotor blades;

providing a support plate which has a longitudinal direction and two opposed offsets which are arranged along the longitudinal direction, each offset comprising a flank, a back section being provided between the two flanks, inserting one rotor blade into each groove such that a blade root of the rotor blade engages in the groove such that the rotor blade is retained in a form-fitting manner in the groove in a radial direction of the turbomachine rotor;

inserting the support plate into the groove between an underside of the blade root and a bottom of the groove;

screwing a first adjusting screw into a first threaded hole of the blade root and screwing a second adjusting screw into a second threaded hole of the blade root until the adjusting screws contact their corresponding offsets; and tightening the two adjusting screws with a predetermined tightening torque in order to pretension the rotor blade in the groove in the radial direction with a predetermined pretensioning force.

* * * * *